US007267640B2

(12) United States Patent
Patton

(10) Patent No.: US 7,267,640 B2
(45) Date of Patent: Sep. 11, 2007

(54) APPARATUS FOR STRETCHING AND STRENGTHENING MUSCLES

(75) Inventor: Blair Richard Patton, 304 7th Ave., South, Lewistown, MT (US) 59457

(73) Assignee: Blair Richard Patton, Choteau, MT (US)

( * ) Notice: Subject to any disclaimer, the term of this patent is extended or adjusted under 35 U.S.C. 154(b) by 368 days.

(21) Appl. No.: 10/356,051

(22) Filed: Jan. 31, 2003

(65) Prior Publication Data

US 2004/0180764 A1 Sep. 16, 2004

Related U.S. Application Data

(60) Provisional application No. 60/353,519, filed on Jan. 31, 2002.

(51) Int. Cl.
*A63B 21/00* (2006.01)
*A63B 22/00* (2006.01)

(52) U.S. Cl. ..... 482/91; 482/92; 482/128; 482/907

(58) Field of Classification Search ..... 482/34, 482/91, 92, 110, 122, 124, 125, 148, 907
See application file for complete search history.

(56) References Cited

U.S. PATENT DOCUMENTS

| | | | | |
|---|---|---|---|---|
| 5,536,229 | A * | 7/1996 | Albergo | 482/148 |
| 6,203,473 | B1 * | 3/2001 | Atwood | 482/95 |
| 6,447,434 | B1 * | 9/2002 | Waters | 482/140 |
| 6,485,400 | B1 * | 11/2002 | Serlachius | 482/142 |
| 6,569,067 | B1 * | 5/2003 | Madole | 482/148 |

* cited by examiner

*Primary Examiner*—Glenn E. Richman

(57) ABSTRACT

An apparatus for stretching and strengthening muscles from a standing or seated position with a support member having a top end and a bottom end, the top end providing a location for grasping, the bottom end providing a base surface for force distribution and support. A preferred embodiment includes the support member which is adjustable in length such that the distance between the top end and the bottom end is adjustable. A preferred embodiment includes a way for fixedly securing the adjustable support member at desired lengths.

1 Claim, 5 Drawing Sheets

APPARATUS FOR STRETCHING AND STRENGTHENING MUSCLES

CROSS REFERENCE TO RELATED APPLICATIONS

This application is based on provisional application Ser. No. 60/353,519, filed on Jan. 31, 2002.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of exercsie and more specifically to an apparatus for stretching and strengthening muscles which can be used in a standing or seated position. Low back muscle pain is the single most common medical affliction in the United States. Research has concluded that one of the best preventative measures to help prevent back muscle pain, is improving back muscle and leg muscle flexibility. Also, lack of muscle flexibility contributes to numerous sports injuries annually. It is often very difficult to properly stretch tight muscles, because many people lack the ability to actually stretch by themselves. Accessibility to a quick, effective method of stretching muscles which can be utilized virtually anywhere, even on the job, is virtually non-existant. To date there are over 65 million people annually in the United States who suffer from back muscle pain. The vast majority could experience relief from that pain if they could simply effectively and consistantly stretch their inflexible muscles.

Many products on the market today are geared towards looking good, and looking sexy. There is a great void in the area of functional health, and just feeling better. Many products today are not concerned with genuinely helping people feel better, and enjoy pain relief. They are more concerned with a quick sale regardless of the product results. It is obvious when looking at recent statistics, the problems stemming from lack of muscle flexibility are only getting worse. There does not exist in the market today, a product which truly gives people positive results. If there were, the number of people suffering would be getting smaller, not growing. This is precisely the reason a flexibility device which is effective, easy to use, affordable and safe, will undoubtedly have a huge impact in personal health, and wellness worldwide. Not only is there a tremendous need for such a product at home, businesses lose billions of dollars due to back injuries on the job each year. The need for a small, compact flexibility device which may be utilized while at work is also tremendous.

U.S. Pat. No. 4,076,237 granted to Dussia on Feb. 28, 1977, illustrates what many previous flexibility products consisted of Large, cumbersome products which alienate most of the people who really need to stretch, because they lack the ability and know-how to use such products. It is a fact, that the majority of people who suffer from back muscle pain, simply cannot get onto the ground to use a product.

Another such product which is similar in nature is U.S. Pat. No. 4,517,966 granted to von Othegraven on May 21, 1985. This product again relies upon the user to become seated on the ground to perform the exercises. Also, because this device uses an internal spring mechanism, the user is not held in proper stretching form as they lean forward. As the spring compresses, the users back is allowed to curve. This curving puts tremendous pressure on the lower vertabrae, and can actually worsen back conditions. Not only this, the design of this device makes it heavy and not very portable.

U.S. Pat. No. 5,820,520 granted to Sieber on Oct. 13, 1998 reflects a more modern flexibility product. Unfortunately, it still lacks real functionality. For instance, the whole premise of the device is to have people hang from an extended handle bar while supporting their own weight. Supposedly this stretches the back and leg muscles. In theory, this may work, however in real life it simply doesn't occur. In order for the back AND the leg muscles to be stretched, there needs to be bending at the waist. Without this bending, the leg muscles simply are not stretched effectively. An added dilema is finding a way to stretch both the back and leg muscles in a functional standing or sitting position. This product is also almost totally non-portable, and would never be an option for a quick, on the job-type device.

As stated previously, none of the prior art combines functionality, with effectiveness. Either they are too cumbersome to make them usable on a daily basis, they require too much physical ability, they are cost prohibitive, or they simply don't do what people need them to do . . . work. The prior art has neglected to stick with a very basic design, and as a result none of them have really given people what they so desperately need, a simple device which is truly user friendly.

BRIEF SUMMARY OF THE INVENTION

The primary object of the invention is to provide a device which is accessible and easy to use.

Another object of the invention is to effectively stretch a large number of muscles from either a standing or seated position.

Another object of the invention is to decrease muscle pain.

A further object of the invention is to improve athletic performance.

Yet another object of the invention is, to be quick to use.

Still yet another object of the invention is to be lightweight.

Another object of the invention is to be portable.

Another object of the invention is to be affordable.

A further object of the invention is to lowers risk of muscle injury.

Yet another object of the invention is to decrease pressure on vertebral disks.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an apparatus for stretching and strengthening muscles from a standing or seated position comprising: A support member having a top end and a bottom end, the top end providing a means for grasping, the bottom end providing a base member.

In accordance with a preferred embodiment of the invention, there is disclosed an apparatus for stretching and strengthening muscles comprising: A support member having two ends, the support member being adjustable in length such that the distance between ends one and two is adjustable, a grasping means, a means for rotation, a means for length adjustment.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1A:
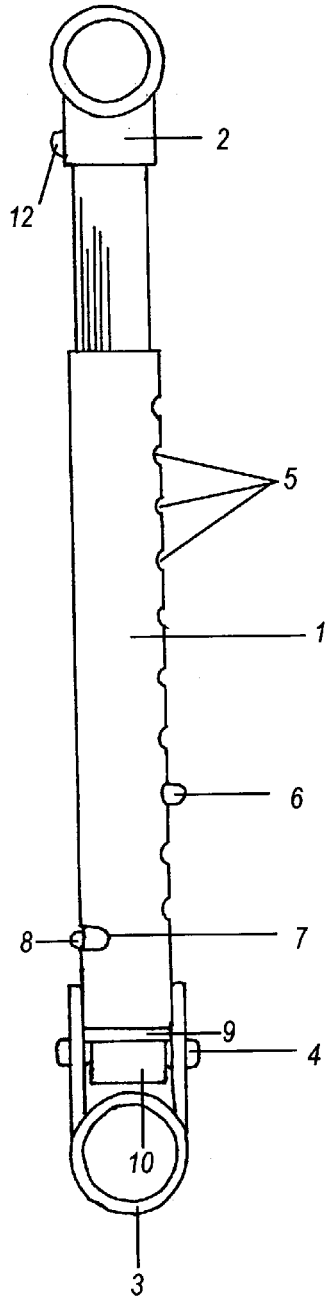
FIG. 1A is a right side orthogonal view of the preferred embodiment of the invention.
Figure 1B:
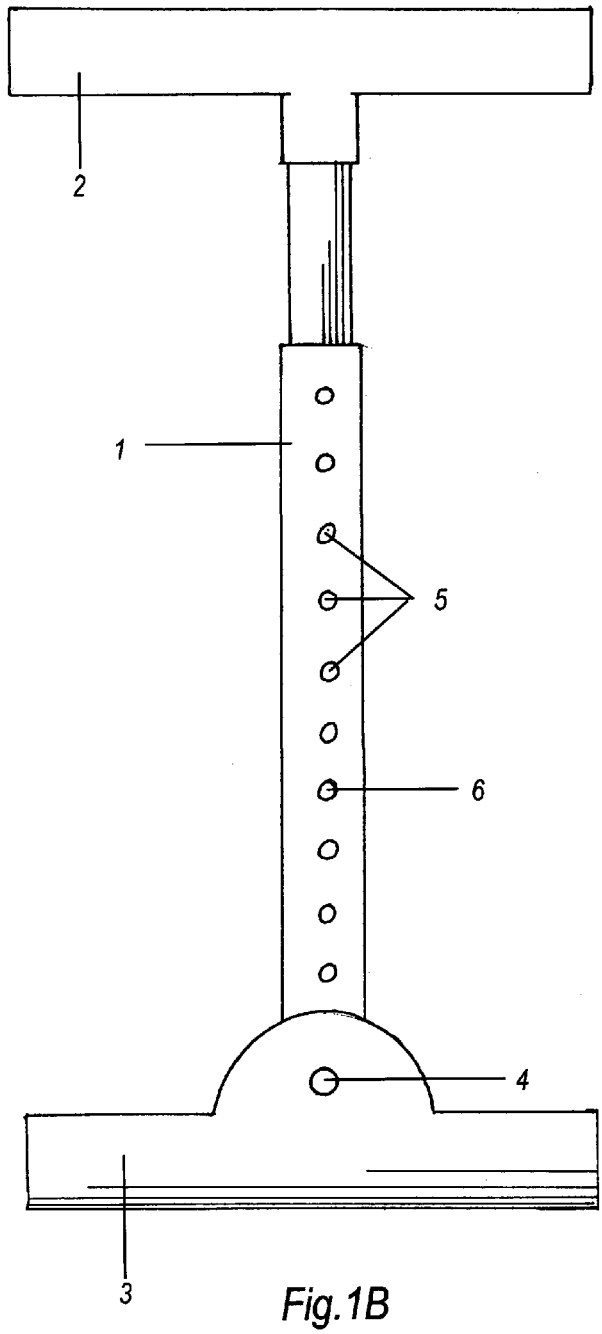
FIG. 1B is a front orthogonal view of the preferred embodiment of the invention.

Turning now to the drawings, in the preferred embodiment of FIG. 1A, the apparatus consists of a support member 1 which is an adjustable tubular structure utilizing a spring/button 6 which engages one of many holes 5 in the support member 1. It is the engagement of the spring/button 6 with one of the holes 5 which allows specific length adjustment. As the support member 1 is lengthened it will allow users with a longer reach to properly use this device for safely stretching and strengthening muscles, also as the support member 1 is shortened people with a shorter reach can properly utilize this device. It should be noted that there are many examples of conventional adjustable support members, such as the legs on crutches or camera tripods. Thus the construction of the support member 1 will not be described in detail hereinafter. The support member 1 has a grasping means 2 at the top end, and the lowermost portion of the preferred embodiment of FIG. 1A includes a base member 3. With the preferred embodiment of FIG. 1A the user is able to place the base member 3 at the bend of their waist, adjust the support member 1 to a length which promotes extended arms, grasp the grasping means 2 with their hands, and gently lean forward. FIGS. 11A–11D show various positions of exercise using this invention. As the user leans forward their muscles become elongated, or stretched. Also pressure is taken from the vertabral disks by utilizing a rigid support member 1 which does not compress as the user leans forward. By starting in a standing position, people with very limited physical ability may utilize the invention. As opposed to the vast majority of other products which call for the user to get on the ground in order to use them. Or, as in FIG. 11B, the user may simply sit in a comfortable chair, position the invention on their lap, and gently lean forward. In FIG. 1A the base member 3 is rotatably and pivotably coupled with the support shaft 1. This rotation will allow the user greater function regarding the variety of exercises which may be performed. More specifically, the base shaft 3 of FIG. 1A articulates with a double sided spring/button 4 which in turn is mounted in the lower end of a hollow tube 10 which also houses a "C" type spring/button 8 at its top. This assembly is shown in detail in FIGS. 2A–2D. The "C" type spring button 8 articulates in an elongated notch 7 located in the posterior side of the support member 1. The length of the elongated notch 7 is the controlling factor as to the range of rotational motion for the base member 3. As the elongated notch 7 becomes longer greater rotational range of motion is allowed, inversely as the elongated notch 7 becomes shorter it restricts travel of the "C" type spring/button 8 thus limiting the rotational travel of the base member 3. The base member 3 is also pivotably coupled with the support means 1 through the articulation of the base member 3 and the double sided spring/button 4. The pivoting and rotational ability of this invention allow the user to maintain a stable base member, and yet rotate the upper body in relationship to their hips. This allows for isolating specific muscles, and de-emphasizing others in a rotational setting. Also the rotary movement allows for an assisted torsion which can specifically stretch a wide range of muscle groups, including, the calf muscles, the hamstrings, the low back muscles, upper back muscles as well as many more. Also apparent from FIG. 1A is a bushing 9 seated between the bottom of the support member 1 and the top of the double sided spring/button 4. This bushing 9 reduces friction at the articulation of the support member 1 and the double sided spring/button 4 producing smooth, and quiet movement. Again referring to FIG. 1A the top of the support member 1 is coupled with a grasping means 2 and held fixedly into place by a spring/button 12 which perforates through aperature 14 on the grasping means 2. The grasping means 2 is removable from the support member 1 by depressing the spring/button, and lifting upward with the grasping means 2. The ease of dissassembly alone sets this invention apart from the prior art. FIG. 1B gives a front view of the same embodiment as FIG. 1A. From this view it is clear to see the plurality of holes 5 for engaging the spring/button 6 and locking the adjustability of the support member 1. FIG. 1B shows the overall elongated nature of the grasping means 2, as well as the base member 3. The double sided spring/button 4 provides the axis for pivoting the base member 3. In the preferred embodiment, the invention may easily be dissassembled by simply depressing the double sided spring/button 4 to release the base assembly 3 from the support shaft 1, and also depressing the spring/button 12 which fixedly connects the grasping means 2 and the support member 1.When dissassembled, the invention will fit in standard luggage, making it ideal for travel situations. As a result, users have the ability to take the apparatus along with them while traveling, helping to maintain consistant usage which has been conclusively shown to improve results. The grasping means 2, the support member 1, and the base member 3 of the preferred embodiment of FIGS. 1A,1B are constructed with hollow aluminum, minimizing the weight of the invention yet retaining functional strength. This design also makes the invention ideal for workers who need to quickly stretch tight muscles while on the job. There are obviously many other materials which may be used to construct the invention, and it is not the intention of the inventor to limit the scope of the invention to any one material.

Figure 2A:
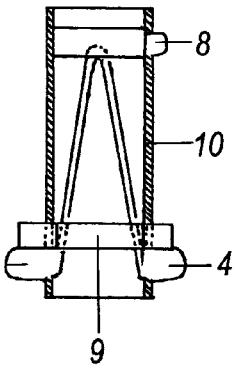
FIG. 2A is a left side sectional view of a means for rotatably and pivotably coupling the base member with the support member.
Figure 2B:
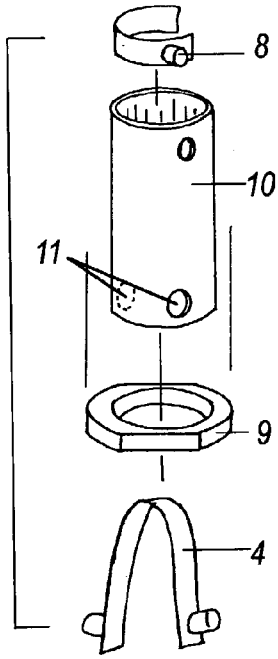
FIG. 2B is an exploded view of a means for rotatably and pivotably coupling the base member with the support member.
Figure 2C:
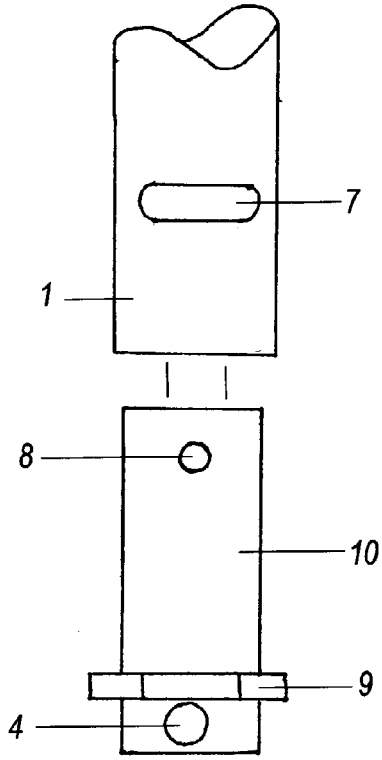
FIG. 2C is a fragmentary rear orthogonal view of a means for rotatably and pivotably coupling the base member with the support member, prior to placement in the support member.
Figure 2D:
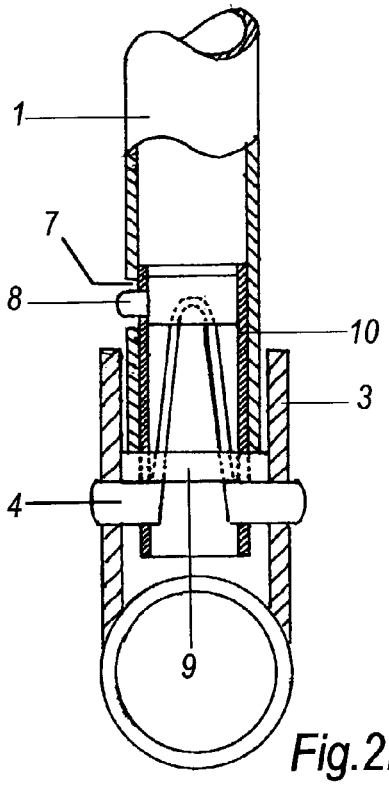
FIG. 2D is a fragmentary right side sectional view of a means for rotatably and pivotably coupling the base member with the support member in the coupled stage.
Figure 3:
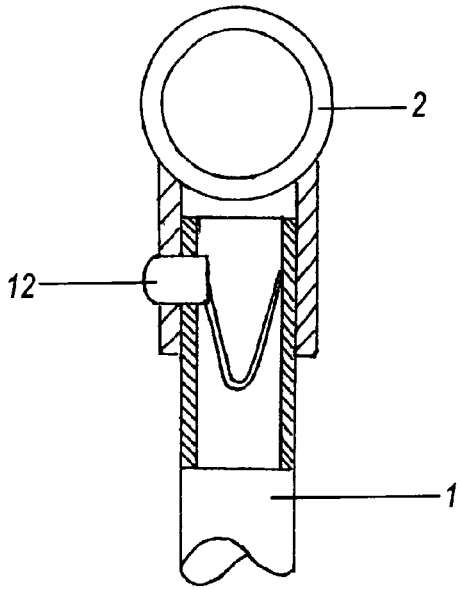
FIG. 3 is a fragmentary right side sectional view of a means for coupling the grasping means and the support member in the coupled stage.
Figure 4:
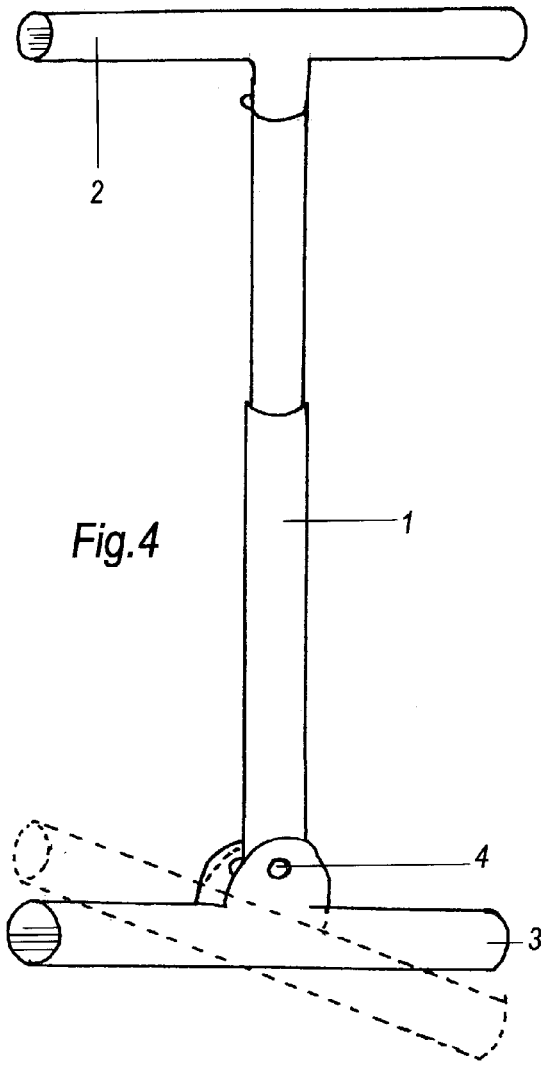
FIG. 4 is a perspective view of an embodiment which has a grasping means, and a base member rotatably coupled with the support member.
Figure 5:
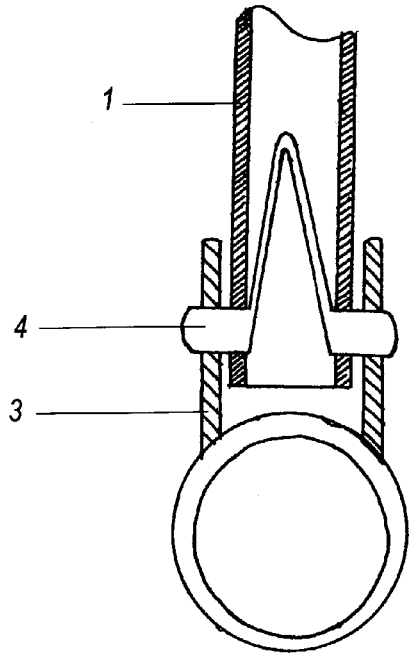
FIG. 5 is a fragmented side sectional view of a means for rotatably coupling a base member with a support member.
Figure 6A:
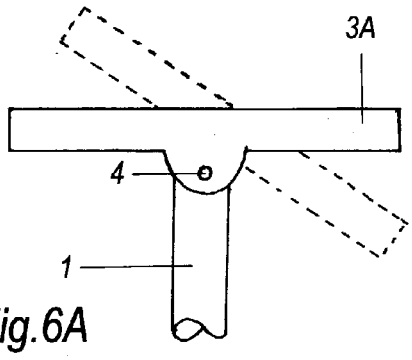
FIG. 6A is a fragmented rear orthogonal view of the grasping means rotatably coupled with a support member.
Figure 6B:
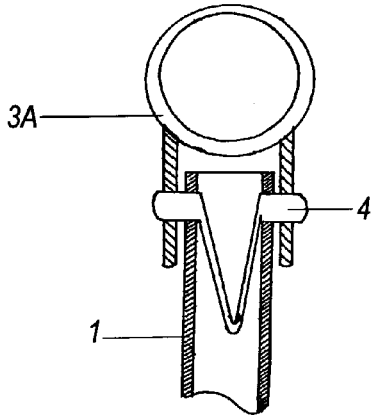
FIG. 6B is a fragmented side sectional view of the grasping means rotatably coupled with the support member.
Figure 7:
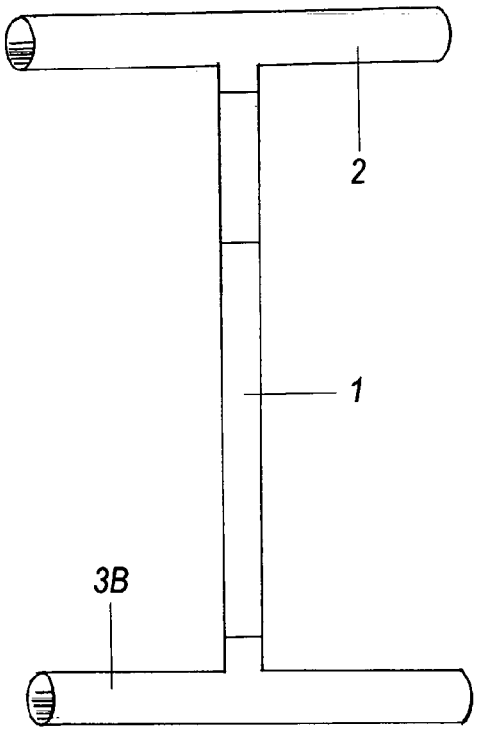
FIG. 7 is a front perspective view of an alternative embodiment of the invention.
Figure 8:
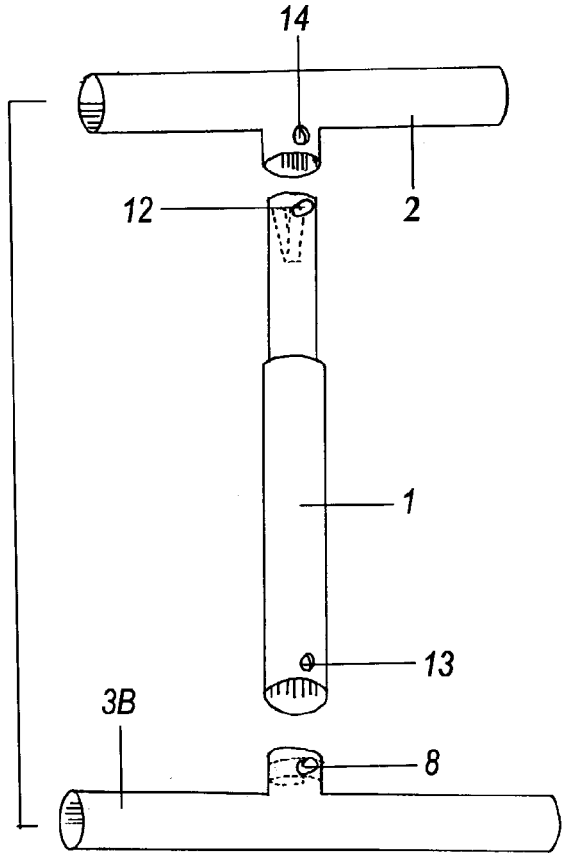
FIG. 8 is an exploded rear view an alternative embodiment of the invention.
Figure 9:
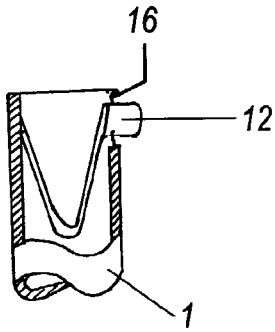
FIG. 9 is a fragmented left sectional view of a means for coupling a grasping means to the support member.
Figure 10:
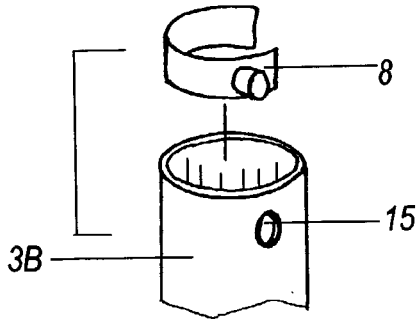
FIG. 10 is a fragmented perspective view of a means for coupling a base member, with the support member.
Figure 11A:
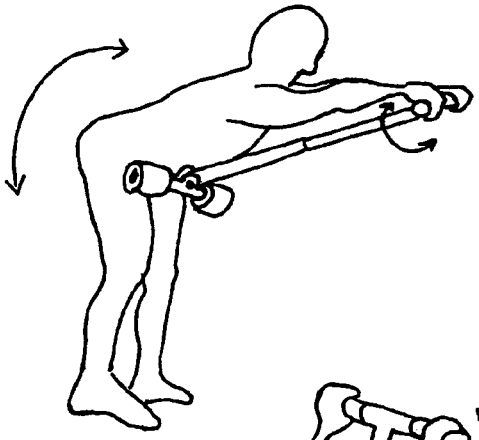
FIGS. 11A–11C show perspectives of different users positions.
Figure 11B:
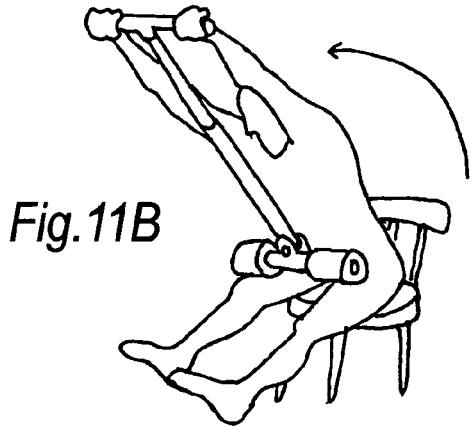
Figure 11C:
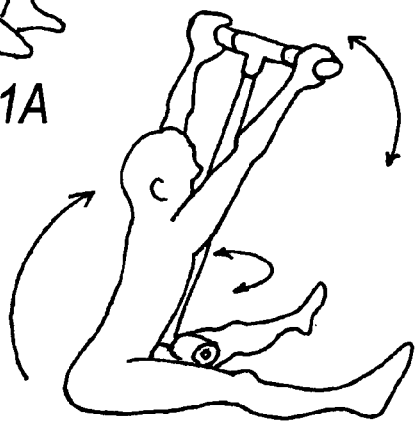
Figure 11D:
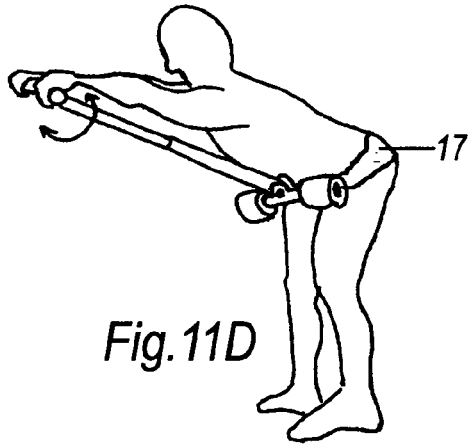
FIG. 11D is a perspective view of a user and a means of coupling the invention with the user.
Figure 12:
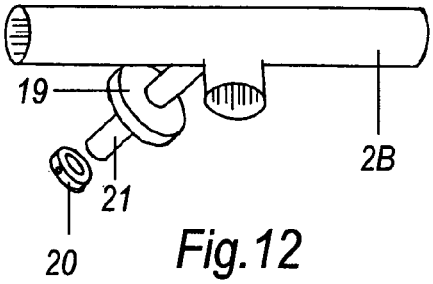
FIG. 12 is a perspective view of a means for attaching resistance or assistance to the grasping means.
Figure 13:
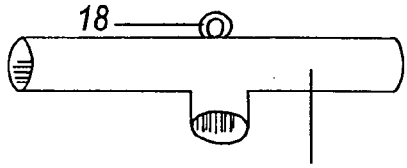
FIG. 13 is a perspective view of a means for attaching resistance or assistance to the grasping means.
Figure 14:
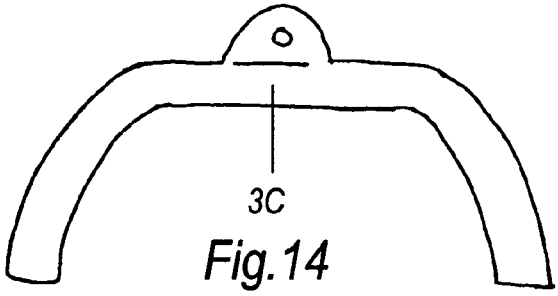
FIG. 14 is a front orthogonal view of a curved embodiment of a base member.
Figure 15:
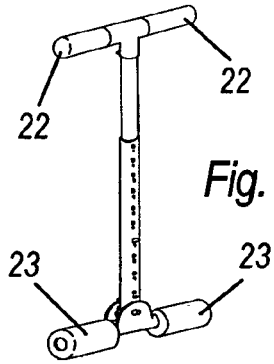
FIG. 15 is a perspective view of the preferred embodiment with enhanced grasping means, and padded base member.

FIG. 2A shows a sectional view of a preferred embodiment of the parts associated with means of rotatably and pivotably coupling the base member 3 and the support member 1. It is clear to see from FIG. 2A the relationship each one of the separate parts has with the other. FIG. 2B is an exploded view of the same components as FIG. 2A It is clear to see the aperatures 11 which engages the double sided spring/button 4 to provide pivotability of the base member 3 in relationship to the support member 1. FIG. 2C is a fragmented rear orthogonal view of the lower end of the support member 1 and the means for rotatably and pivotably coupling the base member 3, seen in FIG. 2D, and the support member 1. From the view of FIG. 2C, the elongated notch 7 in the rear of the support member can be clearly seen and its ability to limit rotational range of motion of the base member 3 can be realized. FIG. 2D shows a fragmented right sided cross sectional view of the support member 1, the base member 3 and the means for coupling the base member 3 rotatably and pivotably 4,8,9,10, with the support member 1. The rotation and pivot assembly comprised of individual components 4,8,9,and 10 is very durable, inexpensive, lightweight and easily assembled. Such manufacturing attributes promise to keep manufacturing costs down, so the invention is more accessable by a diverse economic population. FIG. 3 shows a fragmented right sided sectional view of the removable attachment of grasping means 2, and support member 1. Specific attention is placed on the interaction of the spring/button 12. By depressing the spring/button 12 the grasping means 2 is allowed to be removed because the spring/button 12 will no longer be engaged with the support member 1. FIG. 4 is a perspective view of an alternative embodiment which comprises a grasping means 2, a support member 1, and a base member 3 which is rotatably coupled with the support member 1 by virtue of the articulation of a double sided spring/button 4 and the base member 3. FIG. 5 is a fragmented side sectional view of a double sided spring/button 4 providing a means for rotatably coupling a base member 3 with the support member 1. FIG. 6A is a fragmented rear orthogonal view of a grasping means 3A rotatably coupled with a support member 1, the doublesided spring/button 4 provides a pivotable connection between support member 1 and grasping means 3A. FIG. 6B is a fragmented side sectional view of a grasping means 3A rotatably coupled with the support member 1. FIG. 7. is a front perspective view of an alternative embodiment of the invention. FIG. 7 shows an alternative embodiment of the invention in which a base member 3B is fixedly attached to a support member 1. FIG. 8 is an exploded rear view of the alternative embodiment of the invention from FIG. 7. FIG. 9 shows the internal details of a grasping means 2 coupling mechanism for connecting with the support member 1 from FIG. 8 which can be fixedly attached to a support member 1 by utilizing an aperature 16 in the support member 1 which allows the spring/button 12 to engage the aperature 14 in the grasping means 2. FIG. 10 shows a means for which to attach base member 3B to support member 1, utilizing a "C" style spring/button 8 to fixedly engage the aperature 13 in the lower end of the support member. This alternative embodiment allows for a simple fixed connection between base member 3B and support member 1. By using the alternative embodiment of FIG. 14 which comprises a generally curved base member 3C, with the invention of FIG. 1, it is possible to reduce travel by the invention while on or in the users lap. Other alternative embodiments include FIG. 12, which show an alternative embodiment of the grasping means 2B, which includes a means 21 for adding resistance 19 to the invention and having a means to secure it 20. The addition of resistance and possibly assistance gives the invention a quality for not only improving muscle flexibility, but also improving muscle strength. FIG. 13 shows an additional embodiment of the grasping means 2C, which includes an attachment site 18 for elastic tubing, or bands. This embodiment would allow users to incrementally incorporate elastic resistance or assistance, to their exercise program using the invention. FIG. 15 shows the preferred embodiment of the invention with the addition of padding 23 for the base member, and enhanced grasping means in the form of grips 22. The addition of the pads 23, and grips 22, would give the user greater comfort while using the invention by greater force distribution and softer contact surfaces.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An apparatus for stretching and strengthening muscles from a standing or seated position comprising:

(a) a tubular, aluminum, telescopic support member having first and second ends, (b) a means for selectively and fixedly adjusting the length of the said support member such that the distance between the first and second end is adjustable, (c) a removable handle bar attached perpendicularly to said first end for the purpose of extending and supporting the arms in a fully extended position, (d) a removable , padded base member extending perpendicularly to said second end of said support member, said base member being rotatably and pivotably coupled with said second end of said support member, and a means for connecting resistance or assistance to said removable handle bar.

* * * * *